US009011739B2

(12) United States Patent
Wu et al.

(10) Patent No.: US 9,011,739 B2
(45) Date of Patent: Apr. 21, 2015

(54) METHODS OF CONTINUOUSLY MANUFACTURING POLYMIDE FIBERS

(75) Inventors: Dezhen Wu, Beijing (CN); Hongqing Niu, Beijing (CN); Shengli Qi, Beijing (CN); Enlin Han, Beijing (CN); Xiaona Yan, Beijing (CN); Guofeng Tian, Beijing (CN); Xiaodong Wang, Beijing (CN)

(73) Assignee: Beijing University of Technology, Beijing (CN)

( * ) Notice: Subject to any disclaimer, the term of this patent is extended or adjusted under 35 U.S.C. 154(b) by 568 days.

(21) Appl. No.: 13/400,017

(22) Filed: Feb. 17, 2012

(65) Prior Publication Data

US 2012/0228797 A1 Sep. 13, 2012

(30) Foreign Application Priority Data

Mar. 11, 2011 (CN) ..... 2011 1 0058299

(51) Int. Cl.

| | |
|---|---|
| ***D01D 5/06*** | (2006.01) |
| ***D01D 5/12*** | (2006.01) |
| ***D01D 10/02*** | (2006.01) |
| ***D01D 10/06*** | (2006.01) |
| ***D01F 6/96*** | (2006.01) |
| ***D01F 6/74*** | (2006.01) |
| ***D02J 1/22*** | (2006.01) |

(52) U.S. Cl.

CPC .. *D01F 6/74* (2013.01); *D02J 1/222* (2013.01)

(58) Field of Classification Search

CPC ..... D01D 5/06; D01D 5/12; D01D 10/02; D01D 10/06; D01F 6/96; D02J 1/222

USPC ..... 264/102, 169, 178 F, 184, 203, 210.8, 264/211.12, 211.15, 211.17, 233, 234

See application file for complete search history.

(56) References Cited

U.S. PATENT DOCUMENTS

| | | | | |
|---|---|---|---|---|
| 5,124,428 | A * | 6/1992 | Yokelson et al. | 264/178 F X |
| 5,232,472 | A * | 8/1993 | Simmons et al. | 96/14 |
| 7,776,246 | B2 * | 8/2010 | Allen et al. | 264/211.12 |
| 2011/0144297 | A1 * | 6/2011 | Dennes et al. | 528/183 |

FOREIGN PATENT DOCUMENTS

CN 101525783 A * 9/2009

* cited by examiner

*Primary Examiner* — Leo B Tentoni

(74) *Attorney, Agent, or Firm* — Han IP Corporation

(57) ABSTRACT

Methods for making high quality polyimide fibers suitable for continuous industrial production are described. Polyimide fibers are continuously prepared from a polyamic acid solution through sequentially spinning the polyamic acid solution by either a wet or a dry-wet process, coagulating, drying or drying after washing, thermally treating and stretching the resulting polyamic acid fibers to obtain polyimide fibers, and winding polyimide fibers as prepared into rolls.

16 Claims, 3 Drawing Sheets

METHODS OF CONTINUOUSLY MANUFACTURING POLYMIDE FIBERS

CROSS-REFERENCE TO RELATED APPLICATION

This application claims the priority benefit of Chinese Patent Application No. 201110058299.2, filed on Mar. 11, 2011. The entirety of the above-identified patent application is hereby incorporated by reference and made a part of this specification.

TECHNICAL FIELD

The present disclosure relates to the technical field of polyimide fibers, and particularly relates to methods for continuously preparing high-performance polyimide fibers from a polyamic acid solution.

BACKGROUND

Polyimide fibers as a kind of high-performance fibers have many outstanding properties, such as high strength, high modulus, resistance to both high and low temperatures, and to radiation, flame and chemical corrosion, and desirable biocompatibility and dielectric properties. They have been used in a broad range of applications, including atomic energy industry, space environment, rescue, aeronautics and astronautics, national defense, new-type buildings, high-speed transport means, ocean development, sports equipment, new energies, environmental industry and protective appliances.

Currently, there are two commonly used methods to prepare polyimide fibers. One is a one-step process, in which a polyimide solution is used as a spinning solution, and polyimide fibers are spun by either a wet or a dry-wet process from the spinning solution. After preliminary stretching, the fibers possess certain strength. After removal of solvent, thermal stretching and thermal treatment (300° C.~500° C.) are conducted to obtain high-strength, high-modulus polyimide fibers. Although this method features a simple spinning process, the commonly used solvents in synthesizing polyimide are phenol-based (e.g., cresol and parachlorophenol) which are highly toxic and have high boiling points, as a result, the residual solvent in fibers could not be completely removed. Therefore, this method is not environmentally friendly and is not suitable for industrial application. The Chinese invention patent ZL 02112048.X and the U.S. patents U.S. Pat. No. 4,370,290 and U.S. Pat. No. 5,378,420 all disclose such one-step polyimide fiber preparation method. Another method is the one using a two-step process, in which polyamic acid fibers are first obtained by spinning a concentrated polyamic acid solution using either a wet or a dry-wet process. The polyamic acid fibers as prepared are then chemically or thermally cyclized and stretched to obtain polyimide fibers. For example, the Japanese patents JP3287815 and JP4018115 both adopt this method to prepare polyimide fibers. The raw materials (diamines and dianhydrides) and polyamic acid precursor polymers are soluble in a number of solvents having lower toxicity and boiling points. Thus, the two-step method can overcome the processing difficulties resulting from the infusibility and insolubility of polyimide fibers. In addition, the amounts of residual solvent in the fibers are low. However, the properties of the polyamic acid fibers obtained in the initial polymerization step will deteriorate over time, and after winding of polyamic acid fibers, the small amount of residual solvents that are still left in the fibers will become nonvolatile and will affect the storage and performance of polyamic acid fibers, therefore the performance of the polyimide fibers converted from the polyamic acid fibers is not very high. Moreover, the multiple steps adopted in this method make it unsuitable for continuous production. Accordingly, there remains a need to develop new processing methods for making high quality polyimide fibers suitable for continuous industrial production.

SUMMARY

The present disclosure provides methods for making high quality polyimide fibers suitable for continuous industrial production.

In one aspect, a method for continuously preparing polyimide fibers from a polyamic acid solution may comprise reacting a diamine and a dianhydride in a solvent to obtain a polyamic acid solution; filtering the polyamic acid solution; defoaming the filtered polyamic acid solution under vacuum; spinning the defoamed polyamic acid solution to obtain polyamic acid fibers; coagulating polyamic acid fibers in a solvent; drying polyamic acid fibers; treating and stretching the dried polyamic acid fibers in a tubular heating furnace having at least three furnace segments to form polyimide fibers; and winding polyimide fibers to obtain rolls of polyimide fibers.

In some embodiments, the diamine is a 4,4'-diaminodiphenyl ether (ODA), a p-phenylenediamine (p-PDA), or a mixture thereof.

In some embodiments, the dianhydride is a 3,3',4,4'-benzophenonetetracarboxylic dianhydride (BTDA), a pyromellitic dianhydride (PMDA), a biphenyltetracarboxylic dianhydride (BPDA), or a mixture thereof.

In some embodiments, the molar ratio of the diamine and dianhydride is about 1:0.95 or 1:1.05.

In some embodiments, the solvent used in reacting the diamine and dianhydride is N,N-dimethylformamide (DMF), N,N-dimethylacetylamide (DMAC), N-methylepyrrolidone (NMP), dimethyl sulfoxide (DMSO), or a mixture thereof.

In some embodiments, reaction of the diamine and dianhydride is performed at a temperature from about −10° C. to about 70° C. for a period time from about 2 h to about 20 h under nitrogen.

In some embodiments, the solid content of the polyamic acid solution is from about 10% to about 25%.

In some embodiments, the solvent used for coagulation is water, methanol, ethanol, glycol, acetone, toluene, DMF, DMAc, NMP, DMSO, or a mixture thereof.

In some embodiments, the method for continuously preparing polyimide fibers from a polyamic acid solution may further comprise washing the coagulated polyamic acid fibers by a solvent.

In some embodiments, the solvent used to wash polyamic acid fibers is water, methanol, ethanol, glycol, acetone, toluene, DMF, DMAc, NMP, DMSO, or a mixture thereof.

In some embodiments, the thermal treatment and stretching is performed in a tubular heating furnace having three furnace segments for a total period of time from about 5 min to about 25 min at a temperature from about 80° C. to about 280° C. in the first furnace segment, from about 200° C. to about 450° C. in the second furnace segment, and from about 400° C. to about 550° C. in the third furnace segment, and wherein nitrogen protection is provided when the set temperature of the furnace segments is higher than 350° C.

In some embodiments, the thermal treatment and stretching is performed in a tubular heating furnace having four furnace segments for a total period of time from about 5 min to about 25 min at a temperature from about 100° C. to 200°

C. in the first furnace segment, from about 200° C. to 300° C. in the second furnace segment, from about 280° C. to 350° C. in the third furnace segment, and from about 400° C. to 430° C. in the fourth segment, and wherein nitrogen protection is provided in the fourth segment.

In some embodiments, the thermal treatment and stretching is performed in a tubular heating furnace having five furnace segments for a total period of time from about 5 min to about 25 min at a temperature about 120° C. in the first furnace segment, about 200° C. in the second furnace segment, from about 280° C. to about 380° C. in the third furnace segment, from about 350° C. to about 400° C. in the fourth furnace segment, and from about 420° C. to about 430° C. in the fifth furnace segment, and wherein nitrogen protection is provided when the set temperature of the furnace segments is higher than 350° C.

In some embodiments, the stretching ratio during the thermal treatment is from about 1.2 to about 7.

DETAILED DESCRIPTION OF SAMPLE EMBODIMENTS

The object of the present disclosure is to provide a method for continuously preparing polyimide fibers from a polyamic acid solution to overcome the problems associated with the conventional one-step or two-step processing method.

The present disclosure provides a method for making high quality polyimide fibers suitable for continuous industrial production, wherein polyimide fibers are continuously prepared from a polyamic acid solution through sequentially spinning the polyamic acid solution by either a wet or a dry-wet process, coagulating, drying or drying after washing, thermally treating and stretching the resulting polyamic acid fibers to obtain polyimide fibers, and winding polyimide fibers as prepared.

Figure 1:
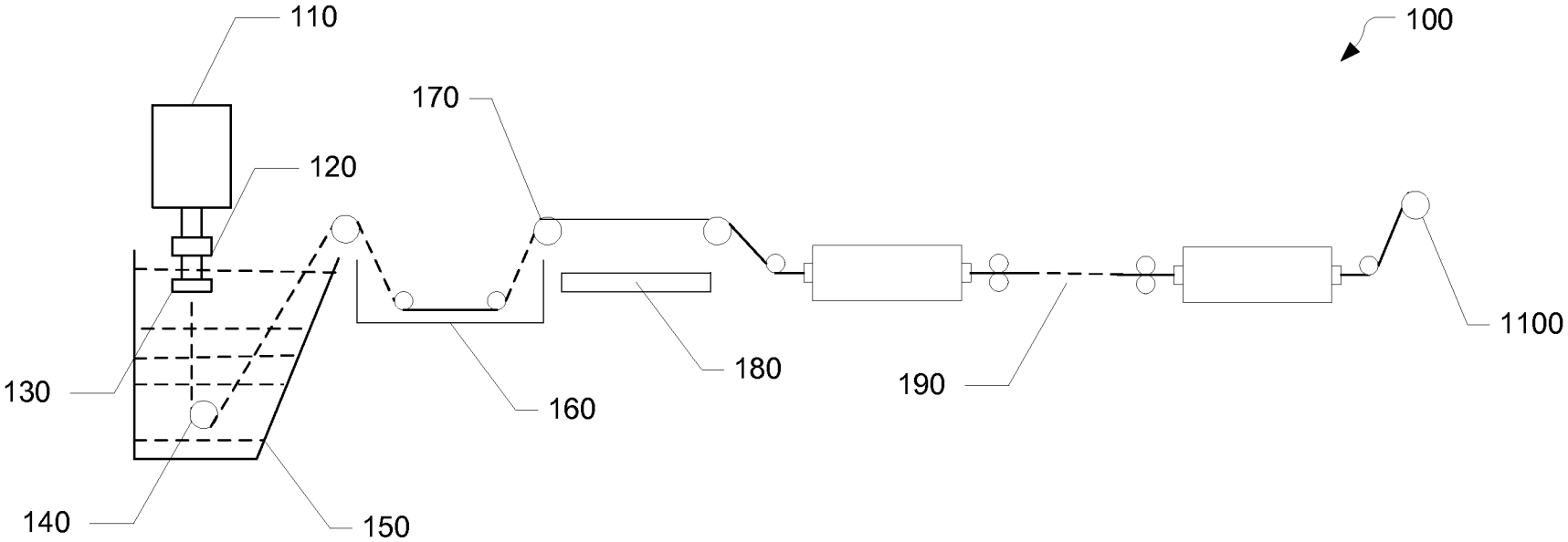
FIG. 1 is an example system that can be utilized to implement the integrated polyimide fiber preparation method.

FIG. 1 illustrates an example system that can be utilized to implement the integrated polyimide fiber preparation method in accordance with at least some embodiments described herein. Referring to FIG. 1, an example fiber making system 100 may include a storage tank 110; a metering pump 120; a spinneret plate 130; a godet roller 140; a coagulating bath 150; a washing bath 160; a hot roller 170; a hot plate 180; a tubular heating furnace 190; and a winding device 1100.

Figure 2:
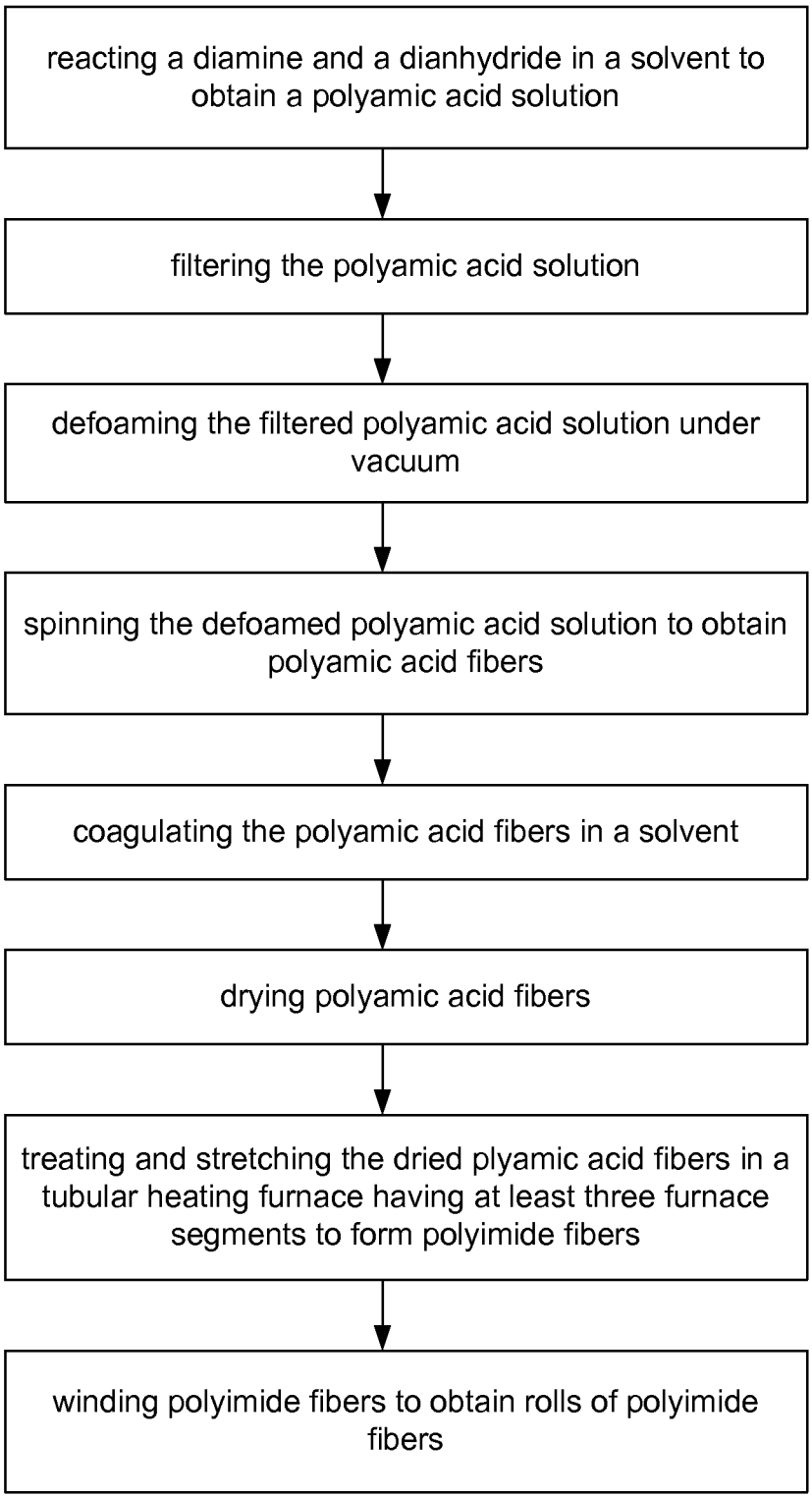
FIG. 2 is a flow diagram of one illustrated method for making polyimide fibers.

FIG. 2 depicts a flow diagram of one illustrated method for making polyimide fibers. Process may begin at reacting a diamine and a dianhydride in a molar ratio of 1:0.95 or 1:1.05 in a solvent at −10 to 70° C. for 2 to 20 h under nitrogen to obtain a polyamic acid spinning solution with solid content of 10-25%. The polyamic acid spinning solution is then filtered, put into the storage tank 110 and defoamed under vacuum, spinning is conducted by either a wet or a dry-wet process and the spinning solution is pumped out by the metering pump 120 and ejected from the spinneret plate 130, the obtained polyamic acid fibers are drawn by the godet roller 140, coagulated in the coagulating bath 150, dried on the hot roller 170 or hot plate 180 directly, then thermally cyclized and stretched in the tubular heating furnace 190 having at least three furnace segments to obtain polyimide fibers, and polyimide fibers are finally collected by the winding device 1100 to obtain rolls of polyimide fibers.

The diamine and dianhydride in the present disclosure are various kinds of diamine (I) and dianhydride (II) monomers used by those in the art to synthesize polyimides, having structures according to following general formulas:

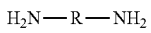

(I)

Diamine

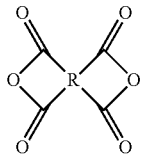

(II)

Dianhydride wherein R stands for a regular structural group of diamine and dianhydride monomers in the art, including aromatic or heterocyclic group.

As used herein, "aromatic" means compounds having aromaticity characteristics. Representative aromatic group includes benzene, biphenyl, and naphthalene.

"Heterocyclic" refers to 3 to 7 member, preferably 5 to 7 membered, unsaturated heteromonocyclic rings, or fused polycyclic rings in which at least one of the fused rings is unsaturated, wherein at least one atom is selected from group consisting of O, S, and N.

Representative diamine includes 4,4'-diaminodiphenyl ether (ODA) and p-phenylenediamine (p-PDA), having the following structures:

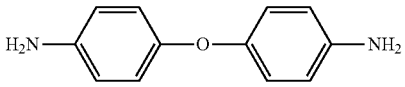

4,4′-Diaminodiphenyl ether (ODA)

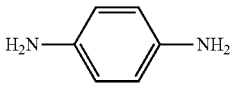

p-phenylenediamine (p-PDA)

Representative dianhydride includes 3,3',4,4'-benzophenonetetracarboxylic dianhydride (BTDA), pyromellitic dianhydride (PMDA), and biphenyltetracarboxylic dianhydride (BPDA), having the following structures:

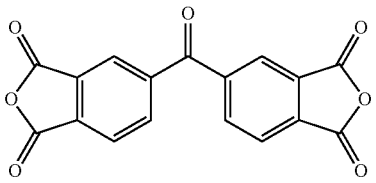

3,3′4,4′-Benzophenonetetracarboxylic dianhydride (BTDA)

-continued

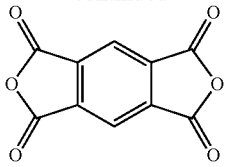

Pyromellitic dianhydride (PMDA)

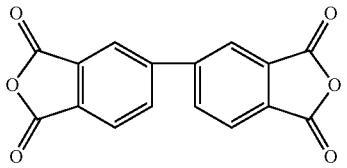

Biphenyltetracarboxylic dianhydride (BPDA)

Representative solvent used in reacting the diamine and dianhydride includes N,N-dimethylformamide (DMF), N,N-dimethylacetylamide (DMAc), N-methylepyrrolidone (NMP, dimethyl sulfoxide (DMSO), and a mixture thereof.

Representative solvent used for coagulation includes water, methanol, ethanol, glycol, acetone, toluene, DMF, DMAc, NMP, DMSO, and a mixture thereof.

The numbers of furnace segments in the tubular heating furnace 190 adopted in the thermal treatment and stretching step of the present disclosure are determined by the heating temperature at each segment and the total heating time when polyamic acid fibers pass the furnace. At least three furnace segments are adopted. Nitrogen protection is provided once the temperature set for the furnace segment is higher than 350° C.

In some embodiments, the thermal treatment and stretching are performed in the tubular heating furnace having three furnace segments for a total period of time from about 5 min to about 25 min at a temperature from about 80° C. to about 280° C. in the first furnace segment, from about 200° C. to about 450° C. in the second furnace segment, and from about 400° C. to about 550° C. in the third furnace segment.

In some embodiments, the thermal treatment and stretching are performed in the tubular heating furnace having four furnace segments for a total period of time from about 5 min to about 25 min at a temperature from about 100° C. to 200° C. in the first furnace segment, from about 200° C. to 300° C. in the second furnace segment, from about 280° C. to 350° C. in the third furnace segment, and from about 400° C. to 430° C. in the fourth segment, and wherein nitrogen protection is provided in the fourth segment.

In some embodiments, the thermal treatment and stretching are performed in a tubular heating furnace having five furnace segments for a total period of time from about 5 min to about 25 min at a temperature about 120° C. in the first furnace segment, about 200° C. in the second furnace segment, from about 280° C. to about 380° C. in the third furnace segment, from about 350° C. to about 400° C. in the fourth furnace segment, and from about 420° C. to about 430° C. in the fifth furnace segment, and wherein nitrogen protection is provided when the set temperature of the furnace segments is higher than 350° C.

Representative stretching ratio during the thermal treatment is from about 1.2 to about 7.

Figure 3:
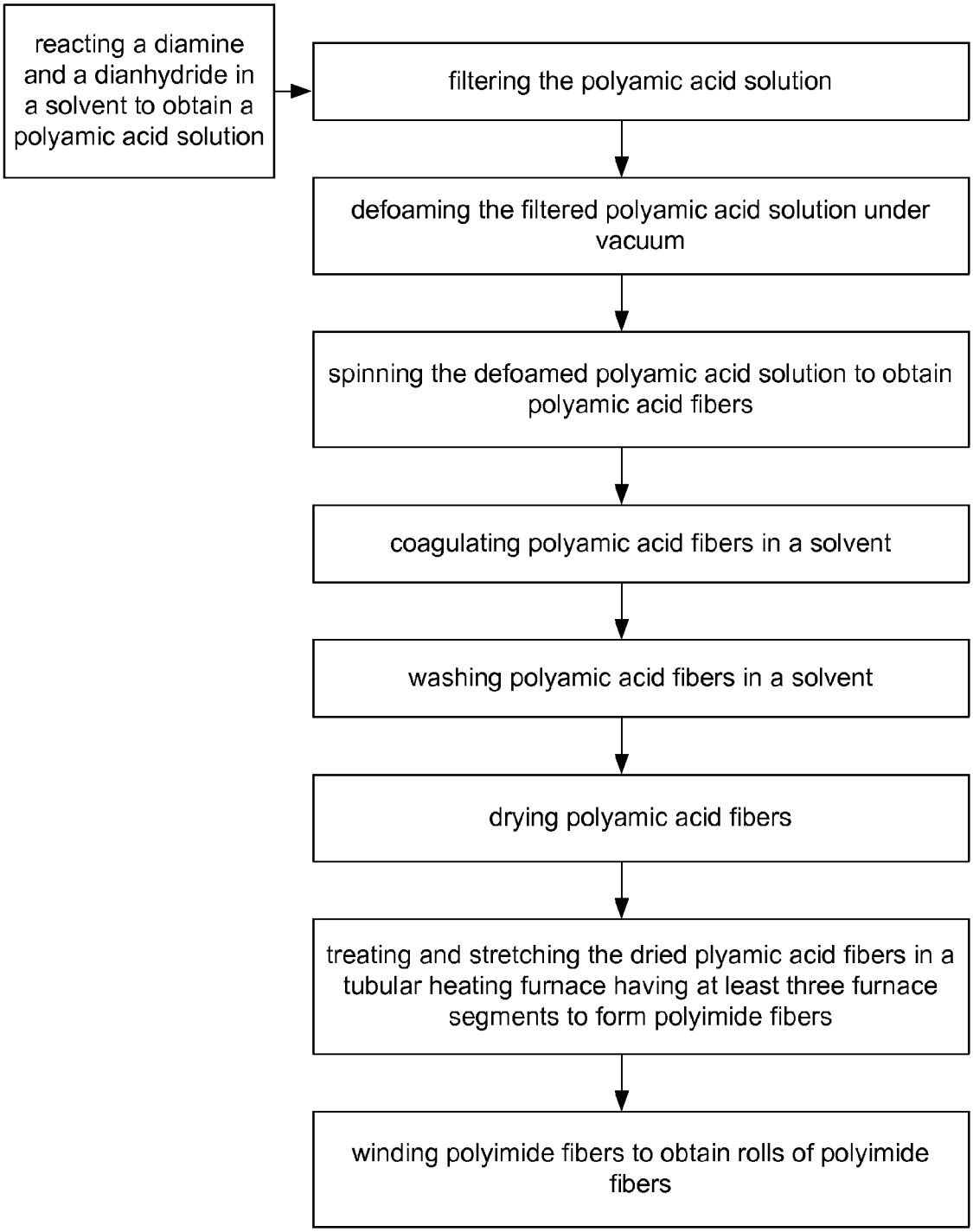
FIG. 3 is a flow diagram of another illustrated method for making polyimide fibers.

The method for continuously preparing polyimide fibers from a polyamic acid solution may further comprise washing the coagulated polyamic acid fibers by a solvent. Referring to FIG. 3, the polyamic acid fibers are being washed in a wash bath 160 right after the coagulation. Representative solvent used to wash polyamic acid fibers includes water, methanol, ethanol, glycol, acetone, toluene, DMF, DMAc, NMP, DMSO, and a mixture thereof.

Comparing to conventional methods, the present disclosure offers several advantages. First, the present disclosure prepares polyimide fibers from a polyamic acid solution in one step. The whole process is smooth, compact and short. A high degree of imidization and a high degree of orientation, and as a result, high-performance polyimide fibers can be obtained through multi-segment thermal treatment and stretching at high temperatures. Therefore, a continuous fiber preparation process is realized, which can significantly facilitate the mass production of polyimide fibers. Second, since polyimide fibers are directly prepared from a polyamic acid solution, the synthetic method is greatly simplified. Furthermore, a broad range of monomers can be selected to make polyimide fibers. Virtually, any diamine and dianhydride monomers that can be used to synthesize the polyamic acid may be used to prepare polyimide fibers.

The following is a description of the preparation and properties of polyimide fibers of the present disclosure. It should be noted that the following embodiments are intended to illustrate and not to limit the technical scheme described in the present disclosure. Therefore, those of ordinary skill in the art should understand they may still make modifications or identical replacements to the present disclosure, and all technical schemes and modifications made without departing from the spirit and scope of the present disclosure shall be within the scope of claims of the present disclosure. For instance, the procedures for synthesizing the polyamic acid of the present disclosure apply to all dianhydrides and diamines in the art. The following embodiments are for illustration only.

EXAMPLES

Example 1

Synthesis of polyamic acid solution: adopting a molar ratio of PMDA:ODA=1.05:1. ODA was first put into a three-neck flask, DMF solvent was add, and the mixture was then stirred under nitrogen. After ODA was completely dissolved, PMDA was added slowly in small portions to make the solid content of the mixture to be 10%. The mixture was then stirred for 5 h at 50° C. to obtain a viscous polyamic acid solution.

Preparation of polyimide fiber: After filtration, the polyamic acid solution was transferred into the storage tank. After vacuum defoaming, spinning by wet process was adopted. After pumped out by the metering pump, the polyamic acid solution was ejected via the spinneret plate. The obtained polyamic acid fiber was drawn by the godet roller and entered into the coagulating bath where it was coagulated. Then it was drawn by the godet roller and entered into the wash bath where it was washed. The water was used in both coagulating bath and wash bath. After thorough wash, the fiber was dried on the hot roller and then entered into the three furnace segments formed in a tubular heating furnace. The temperature in the three segments was 180° C., 260° C. and 420° C., respectively. The total time of thermal treatment was 5 min. Nitrogen protection was provided in the third segment. The stretching ratio was 5. In the end, the fiber was collected and wound by the winding device. The tensile strength of the fiber is 0.5 GPa. The initial modulus is 15.2 GPa.

Example 2

Synthesis of polyamic acid solution: adopting a molar ratio of PMDA:ODA=0.95:1. ODA was first put into a three-neck flask, DMAC solvent was added and the mixture was then stir under nitrogen. After ODA was completely dissolved, PMDA was added slowly in small portions to make the solid content of the mixture to be 20%. The mixture was then stirred 2 h at 0° C. to obtain a viscous polyamic acid solution.

Preparation of polyimide fiber: After filtration, the polyamic acid solution was transferred into the storage tank. After vacuum defoaming, spinning by wet process was adopted. After pumped out by the metering pump, the polyamic acid solution was ejected via the spinneret plate. The obtained polyamic acid fiber was drawn by the godet roller and entered into the coagulating bath containing a mixed solvent of water and ethanol where it was coagulated. Then the fiber was dried on the hot plate and entered into the four furnace segments formed in a tubular heating furnace. The temperature in the four segments was 150° C., 280° C., 300° C. and 400° C., respectively. The total time of thermal treatment was 10 min. Nitrogen protection was provided in the fourth segment. The stretching ratio was 3. In the end, the fiber was collected and wound by the winding device. The tensile strength of the obtained fiber is 0.7 GPa. The initial modulus is 19.3 GPa.

Example 3

Synthesis of polyamic acid solution: adopting a molar ratio of PMDA:ODA=1.05:1. ODA was put into a three-neck flask, DMAc solvent was added and the mixture was then stirred under nitrogen. After ODA was completely dissolved, PMDA was added slowly in small portions to make the solid content of the mixture to be 25%. The mixture was stirred for 2 h at 0° C. and then for 10 h at 40° C. to obtain a viscous polyamic acid solution.

Preparation of polyimide fiber: After filtration, the polyamic acid solution was transferred into the storage tank. After vacuum defoaming, spinning by wet process was adopted. After pumped out by the metering pump, the polyamic acid solution was ejected via the spinneret plate. The obtained polyamic acid fiber was drawn by the godet roller and entered into the coagulating bath containing a mixed solvent of water and DMAc, where it was coagulated. Then it was drawn by the godet roller and entered into the wash bath where it is washed by water. After thorough wash, the fiber was drawn by the hot roller and dried on the hot plate and entered into the four furnace segments formed in a tubular heating furnace. The temperature in the four segments was 180° C., 280° C., 350° C. and 400° C., respectively. The total time of thermal treatment was 18 min. Nitrogen protection was provided in the fourth segment. The stretching ratio was 2. In the end, the fiber was collected and wound by the winding device. The tensile strength of the obtained fiber is 0.8 GPa. The initial modulus is 20.6 GPa.

Example 4

Synthesis of polyamic acid solution: adopting a molar ratio of BPDA:p-PDA=1.05:1. p-PDA was first into a three-neck flask, DMAc solvent was added and the mixture was then stirred under nitrogen. After p-PDA was completely dissolved, BPDA was added slowly in small portions to make the solid content of the mixture to be 20%. The mixture was stirred for 5 h at 0° C. and then for 15 h at 50° C. to obtain a viscous polyamic acid solution.

Preparation of polyimide fiber: After filtration, the polyamic acid solution was transferred into the storage tank. After vacuum defoaming, spinning by wet process was adopted. After pumped out by the metering pump, the polyamic acid solution was ejected via the spinneret plate. The obtained polyamic acid fiber was drawn by the godet roller and entered into the coagulating bath containing a mixed solvent of water and methanol where it is coagulated. Then it was drawn by the godet roller and entered into the wash bath where it was washed by water. After thorough wash, the fiber was dried on the hot plate and entered into the four furnace segments formed in a tubular heating furnace. The temperatures in the four segments were 200° C., 300° C., 350° C. and 400° C., respectively. The total time of thermal treatment was 20 min. Nitrogen protection was provided in the fourth segment. The stretching ratio is 1.7. In the end, the fiber was collected and wound by the winding device. The tensile strength of the obtained fiber is 1.4 GPa. The initial modulus is 78.3 GPa.

Example 5

Synthesis of polyamic acid solution: adopting a molar ratio of BPDA:p-PDA=1.05:1. p-PDA was put into a three-neck flask, DMF solvent was added and the mixture was stirred under nitrogen. After p-PDA was completely dissolved, BPDA was then added slowly in small portions to make the solid content of the mixture to be 15%. The mixture was stirred for 5 h at 0° C. and then for 15 h at 70° C. to obtain a viscous polyamic acid solution.

Preparation of polyimide fiber: After filtration, the polyamic acid solution was transferred into the storage tank. After vacuum defoaming, spinning by wet process was adopted. After pumped out by the metering pump, the polyamic acid solution was ejected via the spinneret plate. The obtained polyamic acid fiber was drawn by the godet roller and entered into the coagulating bath containing a mixed solvent of water and DMF where it is coagulated. Then the fiber was drawn by the hot roller and dried on the hot plate and entered into the four furnace segments formed in a tubular heating furnace. The temperature in the four segments was 100° C., 240° C., 350° C. and 400° C., respectively. The total time of thermal treatment was 25 min. Nitrogen protection was provided in the fourth segment. The stretching ratio was 2.5. In the end, the fiber was collected and wound by the winding device. The tensile strength of the obtained fiber is 1.8 GPa. The initial modulus is 109.8 GPa.

Example 6

Synthesis of polyamic acid solution: adopting a molar ratio of BPDA:p-PDA=1.05:1. p-PDA was put into a three-neck flask, DMSO solvent was added and the mixture was stirred under nitrogen. After p-PDA was completely dissolved, BPDA was added slowly in small portions to make the solid content of the mixture to be 15%. The mixture was stirred for 10 h at 0° C. and then for 5 h at 70° C. to obtain a viscous polyamic acid solution.

Preparation of polyimide fiber: After filtration, the polyamic acid solution was transferred into the storage tank. After vacuum defoaming, spinning by dry-wet process was adopted. After pumped out by the metering pump, the polyamic acid solution was ejected via the spinneret plate. After passing through a 0.8 cm air layer, it was entered into the coagulating bath containing a mixed solvent of water and DMSO where it is coagulated to form polyamic acid fiber. Then the fiber was entered into the wash bath where it is washed by a mixed solvent of water and ethanol. After thorough wash, the fiber was drawn by the hot roller and dried on the hot plate and entered into the five furnace segments formed in a tubular heating furnace. The temperature in the five segments was 120° C., 280° C., 380° C., 400° C. and 420° C., respectively. The total time of thermal treatment was 10 min. Nitrogen protection was provided in the fourth and fifth segments. The stretching ratio was 1.5. In the end, the fiber was collected and wound by the winding device. The tensile strength of the obtained fiber is 2.0 GPa. The initial modulus is 121.2 GPa.

Example 7

Synthesis of polyamic acid solution: adopting a molar ratio of BPDA:p-PDA:ODA=4.2:3:1. p-PDA and ODA were put into a three-neck flask, DMF solvent was added and the mixture was stirred under nitrogen. After p-PDA and ODA were completely dissolved, BPDA was added slowly in small portions to make the solid content of the mixture to be 20%. The mixture was stirred for 10 h at −10° C. and then for 5 h at 0° C. to obtain a viscous polyamic acid solution.

Preparation of polyimide fiber: After filtration, the polyamic acid solution was transferred into the storage tank. After vacuum defoaming, spinning by wet process was adopted. After pumped out by the metering pump, the polyamic acid solution was ejected via the spinneret plate. The obtained polyamic acid fiber was drawn by the godet roller and entered into the coagulating bath containing a mixed solvent of water and DMF where it is coagulated. Then the fiber was drawn by the godet roller and entered into the wash bath where it was washed by a mixed solvent of water and ethanol. After thorough wash, the fiber was drawn by the hot roller and dried on the hot plate and entered the four furnace segments formed in a tubular heating furnace. The temperature in the four segments was 160° C., 280° C., 380° C. and 420° C., respectively. The total time of thermal treatment was 10 min. Nitrogen protection was provided in the fourth segment. The stretching ratio was 4. In the end, the fiber was collected and wound by the winding device. The tensile strength of the obtained fiber is 1.4 GPa. The initial modulus is 63.4 GPa.

Example 8

Synthesis of polyamic acid solution: adopting a molar ratio of BTDA:p-PDA=1.05:1. p-PDA was put into a three-neck flask, DMAc solvent was added, and the mixture was then stirred under nitrogen. After p-PDA was completely dissolved, BTDA was added slowly in small portions to make the solid content of the mixture to be 20%. The mixture was stirred for 5 h at −5° C. and then for 5 h at 0° C. to obtain a viscous polyamic acid solution.

Preparation of polyimide fiber: After filtration, the polyamic acid solution was transferred into the storage tank. After vacuum defoaming, spinning by dry-wet process was adopted. After pumped out by the metering pump, the polyamic acid solution was ejected via the spinneret plate. After passing through a 1.5 cm air layer, it was entered into the coagulating bath containing a mixed solvent of water and DMAc where it was coagulated to form polyamic acid fiber. Then the fiber was entered into the wash bath where it was washed by a mixed solvent of water and ethanol. After thorough wash, the fiber was drawn by the hot roller to remove surface water on the hot plate. The fiber was then entered into the five furnace segments formed in a tubular heating furnace. The temperature in the five segments was 120° C., 200° C., 280° C., 350° C. and 430° C., respectively. The total time of thermal treatment was 15 min. Nitrogen protection was provided in the fifth segment. The stretching ratio was 2. In the end, the fiber was collected and wound via the winding device. The tensile strength of the obtained fiber is 2.1 GPa. The initial modulus is 92.1 GPa.

What is claimed is:

1. A method comprising:

reacting a diamine and a dianhydride in a solvent to obtain a polyamic acid solution;

filtering the polyamic acid solution;

defoaming the filtered polyamic acid solution under vacuum;

spinning the defoamed polyamic acid solution to obtain polyamic acid fibers;

coagulating polyamic acid fibers in a solvent;

drying polyamic acid fibers;

treating and stretching the dried polyamic acid fibers in a tubular heating furnace for a period time from about 5 minutes to about 25 minutes at a plurality of temperatures such that polyimide fibers are continuously prepared from the polyamic acid solution, the tubular heating furnace having three furnace segments, the plurality of temperatures comprising a temperature from about 80° C. to about 280° C. in a first furnace segment of the three furnace segments, a temperature from about 200° C. to about 450° C. in a second furnace segment of the three furnace segments, and a temperature from about 400° C. to about 550° C. in a third furnace segment of the three furnace segments; and winding polyimide fibers to obtain rolls of polyimide fibers.

2. The method of claim 1, wherein the diamine is a 4,4'-diaminodiphenyl ether (ODA), a p-phenylenediamine (p-PDA), or a mixture thereof.

3. The method of claim 1, wherein the dianhydride is a 3,3',4,4'-benzophenonetetracarboxylic dianhydride (BTDA), a pyromellitic dianhydride (PMDA), a biphenyltetracarboxylic dianhydride (BPDA), or a mixture thereof.

4. The method of claim 1, wherein the molar ratio of the diamine and dianhydride is about 1:0.95 or 1:1.05.

5. The method of claim 1, wherein the solvent used in reacting the diamine and dianhydride is N,N-dimethylformamide (DMF), N,N-dimethylacetylamide (DMAC), N-methylepyrrolidone (NMP), dimethyl sulfoxide (DMSO), or a mixture thereof.

6. The method of claim 1, wherein reaction of the diamine and dianhydride is performed at a temperature from about −10° C. to about 70° C. for a period time from about 2 h to about 20 h under nitrogen.

7. The method of claim 1, wherein the solid content of the polyamic acid solution is from about 10% to about 25%.

8. The method of claim 1, wherein the solvent for coagulation is water, methanol, ethanol, glycol, acetone, toluene, DMF, DMAc, NMP, DMSO, or a mixture thereof.

9. The method of claim 1 further comprising:

washing the coagulated polyamic acid fibers by a solvent.

10. The method of claim 9, wherein the solvent used to wash polyamic acid fibers is water, methanol, ethanol, glycol, acetone, toluene, DMF, DMAc, NMP, DMSO, or a mixture thereof.

11. The method of claim 1, wherein nitrogen protection is provided when the set temperature of the furnace segments is higher than 350° C.

12. The method of claim 1, wherein the stretching ratio during the thermal treatment is from about 1.2 to about 7.

13. A method comprising:

reacting a diamine and a dianhydride in a solvent to obtain a polyamic acid solution;

filtering the polyamic acid solution;

defoaming the filtered polyamic acid solution under vacuum;

spinning the defoamed polyamic acid solution to obtain polyamic acid fibers;

coagulating polyamic acid fibers in a solvent;

drying polyamic acid fibers;

treating and stretching the dried polyamic acid fibers in a tubular heating furnace for a period time from about 5 minutes to about 25 minutes at a plurality of temperatures such that polyimide fibers are continuously prepared from the polyamic acid solution, the tubular heating furnace having four furnace segments, the plurality of temperatures comprising a temperature from about 100° C. to about 200° C. in a first furnace segment of the four furnace segments, a temperature from about 200° C. to about 300° C. in a second furnace segment of the four furnace segments, a temperature from about 280° C. to about 350° C. in a third furnace segment of the four furnace segments, a temperature from about 400° C. to about 430° C. in a fourth furnace segment of the four furnace segments; and winding polyimide fibers to obtain rolls of polyimide fibers.

14. The method of claim 13, wherein nitrogen protection is provided in the fourth segment.

15. A method comprising:

reacting a diamine and a dianhydride in a solvent to obtain a polyamic acid solution;

filtering the polyamic acid solution;

defoaming the filtered polyamic acid solution under vacuum;

spinning the defoamed polyamic acid solution to obtain polyamic acid fibers;

coagulating polyamic acid fibers in a solvent;

drying polyamic acid fibers;

treating and stretching the dried polyamic acid fibers in a tubular heating furnace for a period time from about 5 minutes to about 25 minutes at a plurality of temperatures such that polyimide fibers are continuously prepared from the polyamic acid solution, the tubular heating furnace having five furnace segments, the plurality of temperatures comprising a temperature about 120° C. in a first furnace segment of the fifth furnace segments, a temperature about 200° C. in a second furnace segment of the five furnace segments, a temperature from about 280° C. to about 380° C. in a third furnace segment of the five furnace segments, a temperature from about 350° C. to about 400° C. in a fourth furnace segment of the five furnace segments, and a temperature from about 420° C. to about 430° C. in a fifth furnace segment of the five furnace segments; and winding polyimide fibers to obtain rolls of polyimide fibers.

16. The method of claim 15, wherein nitrogen protection is provided when the set temperature of the furnace segments is higher than 350° C.

* * * * *

UNITED STATES PATENT AND TRADEMARK OFFICE

CERTIFICATE OF CORRECTION

PATENT NO. : 9,011,739 B2
APPLICATION NO. : 13/400017
DATED : April 21, 2015
INVENTOR(S) : Dezhen Wu et al.

It is certified that error appears in the above-identified patent and that said Letters Patent is hereby corrected as shown below:

Please correct the error in the Title Page/Item 73/Assignee.

The correct Assignee should read:

BEIJING UNIVERSITY OF CHEMICAL TECHNOLOGY
BEIJING, CHINA

Signed and Sealed this
Fifteenth Day of March, 2016

Michelle K. Lee

Michelle K. Lee
*Director of the United States Patent and Trademark Office*